US010480495B2

(12) United States Patent
Munroe

(10) Patent No.: US 10,480,495 B2
(45) Date of Patent: Nov. 19, 2019

(54) COMPRESSOR WITH FLOODED START CONTROL

(71) Applicant: Emerson Climate Technologies, Inc., Sidney, OH (US)

(72) Inventor: Michael R. Munroe, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 15/951,919

(22) Filed: Apr. 12, 2018

(65) Prior Publication Data

US 2018/0320672 A1 Nov. 8, 2018

Related U.S. Application Data

(60) Provisional application No. 62/502,910, filed on May 8, 2017.

(51) Int. Cl.
*F25B 49/00* (2006.01)
*F04B 11/00* (2006.01)
(Continued)

(52) U.S. Cl.
CPC ..... *F04B 11/0091* (2013.01); *F04B 39/023* (2013.01); *F04B 39/0284* (2013.01);
(Continued)

(58) Field of Classification Search
CPC ..... F25B 2500/28; F04C 29/04; F04C 29/026
See application file for complete search history.

(56) References Cited

U.S. PATENT DOCUMENTS

2003/0034477 A1* 2/2003 Minor ..... C09K 5/044 252/68
2003/0209688 A1* 11/2003 Lee ..... C09K 5/044 252/68

(Continued)

OTHER PUBLICATIONS

International Search Report of the International Searching Authority regarding International Application No. PCT/US2018/031194 dated Aug. 2, 2018.

(Continued)

*Primary Examiner* — Ljiljana V. Ciric
*Assistant Examiner* — Alexis K Cox
(74) *Attorney, Agent, or Firm* — Harness, Dickey & Pierce, P.L.C.

(57) ABSTRACT

A refrigeration system includes compressor and a duct assembly that includes a duct frame and a sensor unit. The duct frame provides a path for evaporating refrigerant from a lubricant sump of the compressor. The sensor unit obtains temperature measurements of the refrigerant and a lubricant within the lubricant sump and heats and evaporates the refrigerant located within the duct frame of the duct assembly. A control module receives temperature measurements from the sensor unit, determines a presence of liquid refrigerant within the lubricant sump of the compressor in response to a determination that an actual temperature change does not correspond with an expected temperature change for the lubricant, and in response to a determination that the actual temperature change corresponds with the expected temperature change for the lubricant, operates the compressor.

15 Claims, 16 Drawing Sheets

(51) Int. Cl.

| | |
|---|---|
| ***F04B 49/02*** | (2006.01) |
| ***F04B 39/02*** | (2006.01) |
| ***F04C 29/04*** | (2006.01) |
| ***F04D 29/58*** | (2006.01) |
| ***F04C 28/06*** | (2006.01) |
| ***F04B 49/06*** | (2006.01) |
| ***F04B 51/00*** | (2006.01) |
| ***F04C 28/28*** | (2006.01) |
| ***F04C 18/02*** | (2006.01) |

(52) U.S. Cl.

CPC ..... *F04B 49/02* (2013.01); *F04B 49/065* (2013.01); *F04B 51/00* (2013.01); *F04C 18/0215* (2013.01); *F04C 28/06* (2013.01); *F04C 28/28* (2013.01); *F04C 29/04* (2013.01); *F04D 29/582* (2013.01); *F04B 2201/0801* (2013.01); *F04B 2203/021* (2013.01); *F04B 2207/03* (2013.01); *F04C 2240/81* (2013.01); *F04C 2270/19* (2013.01); *F25B 2500/26* (2013.01); *F25B 2500/28* (2013.01); *F25B 2600/0251* (2013.01); *F25B 2700/2106* (2013.01); *F25B 2700/21156* (2013.01)

(56) References Cited

U.S. PATENT DOCUMENTS

| | | | | |
|---|---|---|---|---|
| 2004/0194485 | A1 | 10/2004 | Dudley | |
| 2007/0256432 | A1* | 11/2007 | Zugibe | F25B 43/02 62/115 |
| 2010/0254834 | A1 | 10/2010 | Tolbert, Jr. | |
| 2011/0075700 | A1 | 3/2011 | Okoren et al. | |
| 2011/0089472 | A1* | 4/2011 | Cummins | G01N 27/223 257/252 |
| 2012/0041608 | A1* | 2/2012 | Zugibe | G06F 17/5068 700/285 |
| 2014/0308138 | A1 | 10/2014 | Pham | |
| 2016/0018148 | A1 | 1/2016 | Yura | |
| 2016/0319816 | A1* | 11/2016 | Brostrom | F04C 28/28 |
| 2016/0370026 | A1* | 12/2016 | Denton | G05B 17/02 |

OTHER PUBLICATIONS

Written Opinion of the International Searching Authority regarding International Application No. PCT/US2018/031194 dated Aug. 2, 2018.

* cited by examiner

COMPRESSOR WITH FLOODED START CONTROL

CROSS-REFERENCE TO RELATED APPLICATIONS

This application claims the benefit of U.S. Provisional Application No. 62/502,910, filed on May 8, 2017.

FIELD

The present disclosure relates to compressor control and, more specifically, to a system and method for flooded start control of a compressor.

BACKGROUND

This section provides background information related to the present disclosure which is not necessarily prior art.

Compressors are used in a wide variety of industrial and residential applications to circulate refrigerant within refrigeration, HVAC, heat pump, or chiller systems (generally referred to as "refrigeration systems") to provide a desired heating or cooling effect. In any of these applications, the compressor should provide consistent and efficient operation to ensure that the particular refrigeration system functions properly.

The compressor may include a crankcase to house moving parts of the compressor, such as a crankshaft. In the case of a scroll compressor, the crankshaft drives an orbiting scroll member of a scroll set, which also includes a stationary scroll member. The crankcase may include a lubricant sump, such as an oil reservoir. The lubricant sump can collect lubricant that lubricates the moving parts of the compressor.

When the compressor is off, liquid refrigerant in the refrigeration system generally migrates to the coldest component in the system. For example, in an HVAC system, during an overnight period of a diurnal cycle when the HVAC system is off, the compressor may become the coldest component in the system and liquid refrigerant from throughout the system may migrate to, and collect in, the compressor. In such case, the compressor may gradually fill with liquid refrigerant and become flooded.

One issue with liquid refrigerant flooding the compressor is that the compressor lubricant is generally soluble in the liquid refrigerant. As such, when the compressor is flooded with liquid refrigerant, the lubricant normally present in the lubricant sump can dissolve in the liquid refrigerant, resulting in a liquid mixture of refrigerant and lubricant. Further, in an HVAC system, upon startup in a flooded state, sufficient liquid refrigerant may enter the compressor, while vapor refrigerant may not enter the compressor. In such a case, the liquid may be mechanically incompressible and may mechanically damage the compressing surface and other moving parts of the compressor, thereby resulting in compressor malfunction or compressor inoperability.

Further, in an HVAC system, upon startup in the morning of a diurnal cycle, the compressor may begin operation in a flooded state. In such case, the compressor may quickly pump out all of the liquid refrigerant, along with all of the dissolved lubricant, in the compressor. For example, the compressor may pump all of the liquid refrigerant and dissolved lubricant out of the compressor in less than ten seconds. At this point, the compressor may continue to operate without lubrication, or with very little lubrication, until the refrigerant and lubricant returns to the suction inlet of the compressor after being pumped through the refrigeration system. For example, it may take up to one minute, depending on the size of the refrigeration system and the flow control device used in the refrigeration system, for the lubricant to return to the compressor. Operation of the compressor without lubrication, however, can damage the internal moving parts of the compressor, result in compressor malfunction, and reduce the reliability and useful life of the compressor. For example, operation of the compressor without lubrication can result in premature wear to the compressor bearings.

SUMMARY

This section provides a general summary of the disclosure, and is not a comprehensive disclosure of its full scope or all of its features.

The present disclosure provides a system that includes a compressor for a refrigeration system and a duct assembly that includes a duct frame and a sensor unit. The duct frame provides a path for evaporating refrigerant from a lubricant sump of the compressor. The sensor unit is configured to obtain temperature measurements corresponding to at least one of the refrigerant and a lubricant within the lubricant sump. In response to receiving a heat signal, the sensor unit is configured to heat and evaporate the refrigerant located within the duct frame of the duct assembly. The system also includes a control module using a processor configured to execute instructions stored in a non-transitory memory, supply the heat signal to the sensor unit, receive the temperature measurements from the sensor unit, determine a temperature change of the at least one of the refrigerant and the lubricant based on the temperature measurements, determine a presence of liquid refrigerant within the lubricant sump of the compressor in response to a determination that an actual temperature change does not correspond with an expected temperature change for the lubricant, and in response to a determination that the actual temperature change corresponds with the expected temperature change for the lubricant, operate the compressor.

In some configurations, the duct assembly includes an inlet port, an exhaust port, and a mount.

In some configurations, the refrigerant is configured to enter the duct assembly from the lubricant sump through the inlet port and to exit the duct assembly into the suction chamber through the exhaust port.

In some configurations, the mount is configured to couple a first side of the duct frame to a bottom edge of the compressor.

In some configurations, a nozzle assembly is attached to the exhaust port.

In some configurations, the nozzle assembly has a converging portion.

In some configurations, the nozzle assembly has a diverging portion.

In some configurations, the nozzle assembly has an inner cone within the diverging portion.

In some configurations, the duct frame includes a plurality of apertures for vaporization of the refrigerant.

In some configurations, the duct frame is configured to absorb infrared light.

In some configurations, the duct frame includes injection molded plastic.

In some configurations, the sensor unit includes at least one of a thermistor and a diode.

In some configurations, the at least one diode includes a light emitting diode.

In some configurations, the at least one diode includes at least one of a light emitting diode and an infrared light emitting diode.

In some configurations, the control module is configured to supply the heat signal to the sensor unit using a pulse-width modulation (PWM) signal.

In some configurations, the control module is configured to determine an actual heat curve of the at least one of the refrigerant and the lubricant based on the temperature measurements.

In some configurations, the control module is configured to compare the actual heat curve to an expected heat curve of at least one of the lubricant and the refrigerant.

In some configurations, the actual heat curve is based on a plurality of temperature measurements obtained by an array of sensors.

In some configurations, the control module is configured to, in response to a heating period elapsing, (i) discontinue supplying the heat signal to the sensor unit, and (ii) supply a measurement signal. The control module is also configured to receive the temperature measurements from the sensor unit based on the measurement signal.

In another form, the present disclosure provides a method that includes providing, using a processor of a control module and based on instructions stored in a non-transitory memory of the control module, a heat signal to a sensor unit of a duct assembly located within a lubricant sump of a compressor. The method also includes receiving, from the sensor unit, temperature measurements corresponding to a temperature of at least one of a refrigerant and a lubricant located within the lubricant sump. The method also includes determining, using the processor, a temperature change of at least one of the refrigerant and the lubricant based on the temperature measurements. The method also includes determining, using the processor, a presence of liquid refrigerant within the lubricant sump in response to a determination that an actual temperature change does not correspond with an expected temperature change of the lubricant. The method also includes, in response to a determination that the actual temperature change corresponds with the expected temperature change of the lubricant, operating the compressor.

In some configurations, the method further comprises determining, using the processor, a presence of an incorrect liquid refrigerant within the lubricant sump in response to the determination that the actual temperature change does not correspond with the expected temperature change of the lubricant.

In some configurations, the method further comprises determining an amount of lubricant in the lubricant sump based on a first heating curve associated with a first portion of the sensor unit and a second heating curve associated with a second portion of the sensor unit.

In some configurations, the method further comprises determining an amount of lubricant in the lubricant sump based on at least one cycle time of the lubricant.

In some configurations, the method further comprises determining an amount of lubricant in the lubricant sump based on the temperature measurements.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1A:
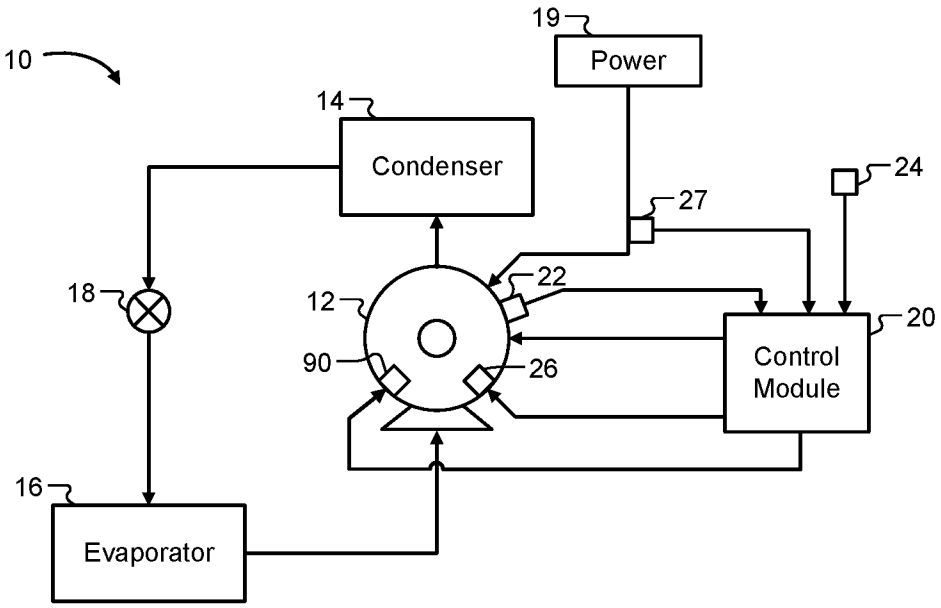
FIG. 1A is a functional block diagram of an example system according to the present disclosure.

With reference to FIG. 1A, a refrigeration system 10 is shown and includes a compressor 12, a condenser 14, an evaporator 16, and a flow control device 18. The refrigeration system 10, for example, may be an HVAC system, with the evaporator 16 located indoors and the compressor 12 and condenser 14 located in a condensing unit outdoors. The flow control device 18 may be a capillary tube, a thermal expansion valve (TXV), or an electronic expansion valve (EXV). The compressor 12 is connected to a power supply 19.

A control module 20 controls the compressor 12 by turning the compressor 12 on and off. More specifically, the control module 20 controls a compressor contactor 40 (shown in FIG. 3) that connects or disconnects an electric motor 42 (shown in FIG. 3) of the compressor 12 to the power supply 19.

With reference again to FIG. 1A, the control module 20 may be in communication with a number of sensors. For example, the control module 20 may receive outdoor ambient temperature data from an outdoor ambient temperature sensor 24 that may be located outdoors near the compressor 12 and condenser 14 to provide data related to the ambient outdoor temperature. The outdoor ambient temperature sensor 24 may also be located in the immediate vicinity of the compressor 12 to provide data related to the temperature at a location in the immediate vicinity of the compressor 12. Alternatively, the control module 20 may receive the outdoor ambient temperature data through communication with a thermostat, or remote computing device, such as a remote server, that monitors and stores outdoor ambient temperature data. Additionally, the control module 20 may receive compressor temperature data from a compressor temperature sensor 22 attached to and/or located within the compressor 12. For example, the compressor temperature sensor 22 may be located at a lower portion of the compressor 12 due to any liquid refrigerant being located near the bottom of the compressor due to gravity and density. Additionally, the control module 20 may receive electrical current data from a current sensor 27 connected to a power input line between the power supply 19 and the compressor 12. The electrical current data may indicate an amount of current flowing to the compressor 12 when the compressor is operating. Alternatively, a voltage sensor or power sensor may be used in addition to, or in place of, the current sensor 27. Other temperature sensors may be used. For example, alternatively, a motor temperature sensor may be used as the compressor temperature sensor 22.

The control module 20 may also control a crankcase heater 26 attached to or located within the compressor 12. For example, the control module 20 may turn the crankcase heater 26 on and off, as appropriate, to provide heat to the compressor and, more specifically, to the crankcase of the compressor.

The compressor 12 also includes a duct assembly 90 with an infrared (IR) light emitting diode (LED) array, as discussed in further detail below with reference to FIGS. 6 to 13B. The control module 20 may also control and/or receive data from the IR LED array, as discussed in further detail below with reference to FIGS. 6 to 13B.

The control module 20 may be located at or near the compressor 12 at the condensing unit that houses the compressor 12 and condenser 14. In such case, the compressor 12 may be located outdoors. Alternatively, the compressor 12 may be located indoors and inside a building associated with the refrigeration system. Alternatively, the control module 20 may be located at another location near the refrigeration system 10. For example, the control module 20 may be located indoors. Alternatively, the functionality of the control module 20 may be implemented in a refrigeration system controller. Alternatively, the functionality of the control module 20 may be implemented in a thermostat located inside a building associated with the refrigeration system 10. Alternatively, the functionality of the control module 20 may be implemented at a remote computing device.

Figure 1B:
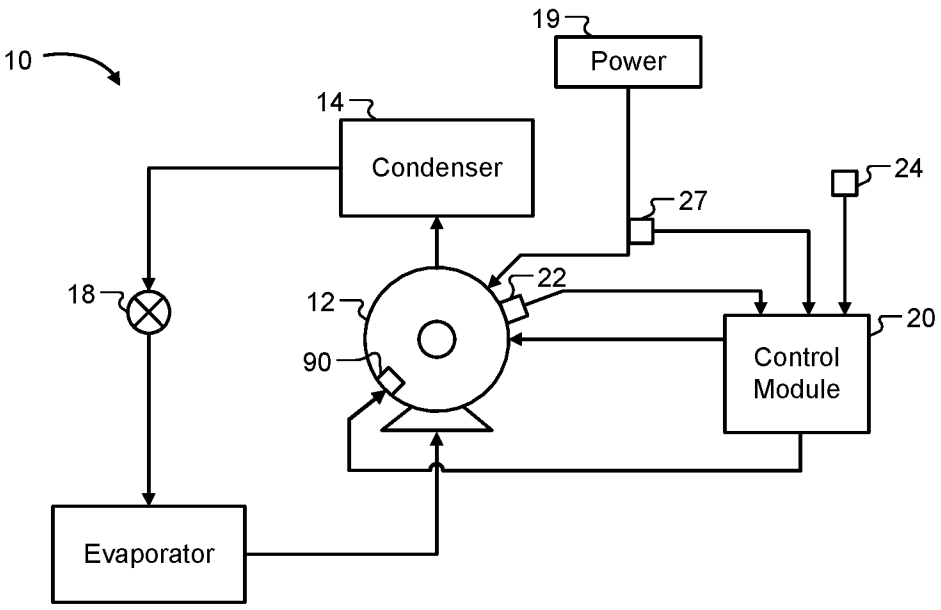
FIG. 1B is a functional block diagram of another example system according to the present disclosure.

With reference to FIG. 1B, another refrigeration system 10 is shown. The refrigeration system 10 of FIG. 1B is similar to the refrigeration system 10 of FIG. 1A except that the compressor 12 of the refrigeration system 10 of FIG. 1B does not include the crankcase heater 26. As described in further detail below, the flooded start control of the present disclosure may be used for compressors 12 both with and without crankcase heaters 26.

Figure 2A:
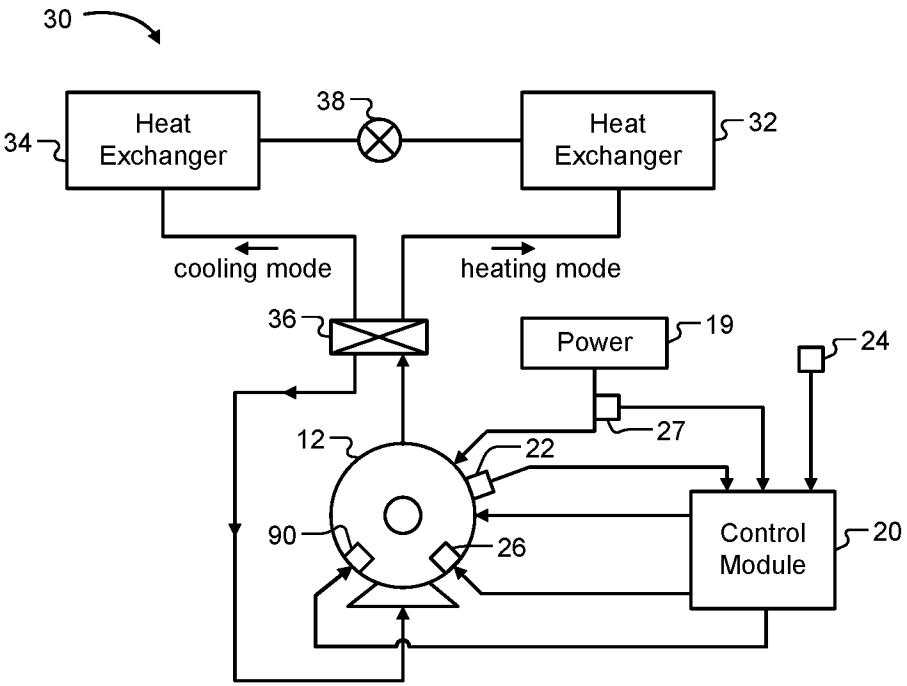
FIG. 2A is a functional block diagram of another example system according to the present disclosure.

With reference to FIG. 2A, another refrigeration system 30 is shown. Refrigeration system 30 is a reversible heat pump system, operable in both a cooling mode and a heating mode. The refrigeration system 30 is similar to the refrigeration systems 10 shown in FIGS. 1A and 1B, except that the refrigeration system 30 includes a four-way reversing valve 36. Further, the refrigeration system 30 includes an indoor heat exchanger 32 and an outdoor heat exchanger 34. In the cooling mode, refrigerant discharged from the compressor 12 is routed by the four-way reversing valve 36 to the outdoor heat exchanger 34, through a flow control device 38, to the indoor heat exchanger 32, and back to a suction side of the compressor 12. In the heating mode, refrigerant discharged from the compressor 12 is routed by the four-way reversing valve 36 to the indoor heat exchanger 32, through the flow control device 38, to the outdoor heat exchanger 34, and back to the suction side of the compressor 12. In a reversible heat pump system, the flow control device 38 may include an expansion device, such as a thermal expansion device (TXV) or electronic expansion device (EXV). Optionally, the flow control device 38 may include a plurality of flow control devices 38 arranged in parallel with a bypass that includes a check valve. In this way, the flow control device 38 may properly function in both the cooling mode and in the heating mode of the heat pump system. Other components of the refrigeration system 30 are the same as those described above with respect to FIG. 1A and their description is not repeated here.

Figure 2B:
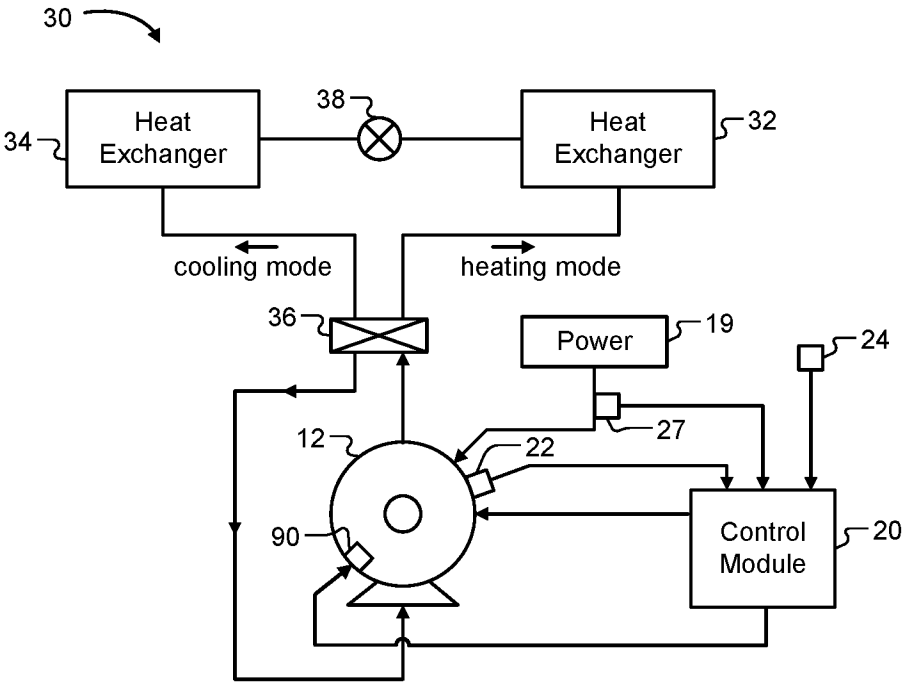
FIG. 2B is a functional block diagram of another example system according to the present disclosure.

With reference to FIG. 2B, another refrigeration system 30 is shown. The refrigeration system 30 of FIG. 2B is similar to the refrigeration system 30 of FIG. 2A except that the compressor 12 of the refrigeration system 30 of FIG. 2B does not include the crankcase heater 26. As described in further detail below, the flooded start control of the present disclosure may be used for compressors 12 both with and without crankcase heaters 26.

Figure 3:
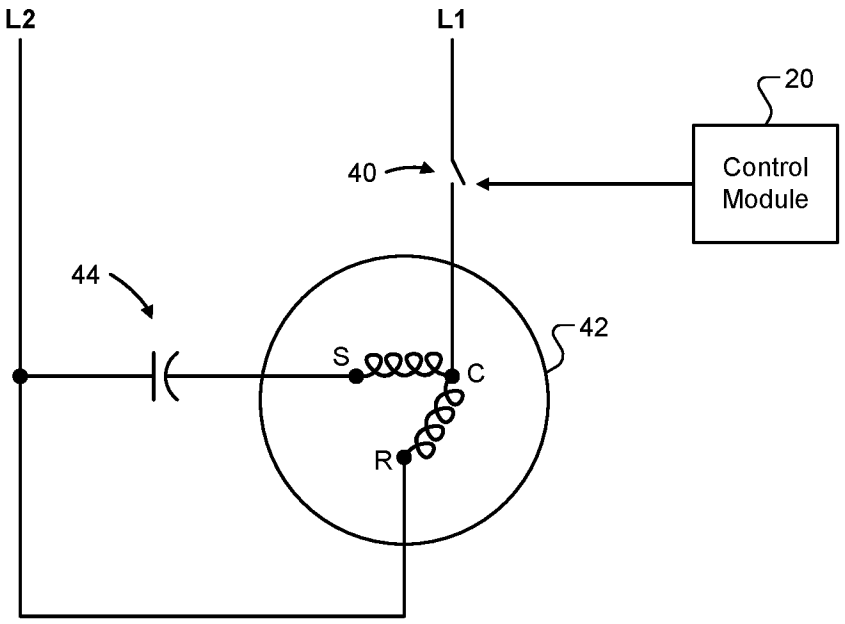
FIG. 3 is a functional block diagram of an example compressor motor according to the present disclosure.

With reference to FIG. 3, the electric motor 42 of the compressor 12 is shown. As shown, a first electrical terminal (L1) is connected to a common node (C) of the electric motor 42. A start winding is connected between the common node (C) and a start node (S). A run winding is connected between the common node (C) and a run node (R). The start node (S) and the run node (R) are each connected to a second electrical terminal (L2). A run capacitor 44 is electrically coupled in series with the start winding between the start node (S) and the second electrical terminal (L2).

The control module 20 turns the electric motor 42 of the compressor on and off by opening and closing the compressor contactor 40 that connects or disconnects the common node (C) of the electric motor 42 to electrical terminal (L1).

Figure 4:
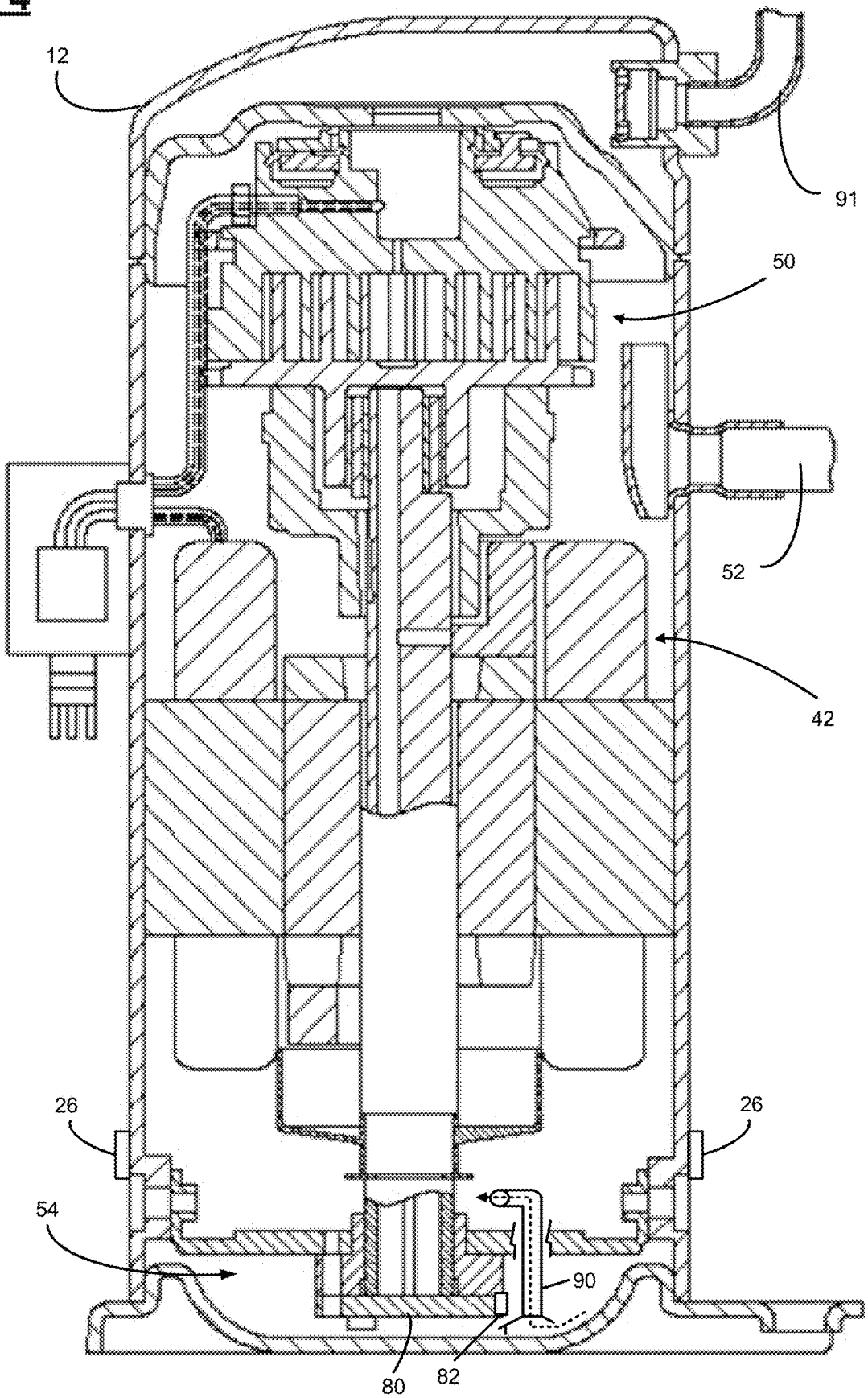
FIG. 4 is a cross-sectional view of an example compressor according to the present disclosure.

With reference to FIG. 4, a cross-section of a low-side scroll compressor 12 is shown and includes a scroll set 50, with an orbiting scroll member driven by a crankshaft, which, in turn, is driven by electric motor 42. The scroll set 50 also includes a stationary scroll member. A crankcase of the compressor 12 includes a lubricant sump 54, such as an oil reservoir. The compressor 12 shown in FIG. 4 includes the crankcase heater 26. While the compressor 12 of FIG. 4 is shown with the crankcase heater 26, as discussed in detail above and below, the flooded start control of the present disclosure may be used for compressors without a separate crankcase heater 26, as shown in FIG. 4. The crankcase heater 26 shown in FIG. 4 is a bellyband type crankcase heater 26 located on an exterior of a shell of the compressor 12 and encircling the compressor 12. Other types of crankcase heaters 26, however, may be used, including crankcase heaters 26 that are internal to the compressor, as shown, for example, in FIG. 6A. Additionally or alternatively, crankcase heaters 26 that utilize the stator of the electric motor 42 as the crankcase heater 26 can also be used. The compressor 12 also includes the duct assembly 90 with an infrared (IR) light emitting diode (LED) array located within the lubricant sump 54, as discussed in further detail below with reference to FIGS. 6-13B. The compressor 12 also includes a suction inlet 52 and a discharge outlet 91. While a low-side scroll compressor 12 is shown as an example in FIG. 4, the present disclosure may be used with other types of compressors as well, including, for example, reciprocating or rotary type compressors, and/or directed suction type compressors.

Figure 5:
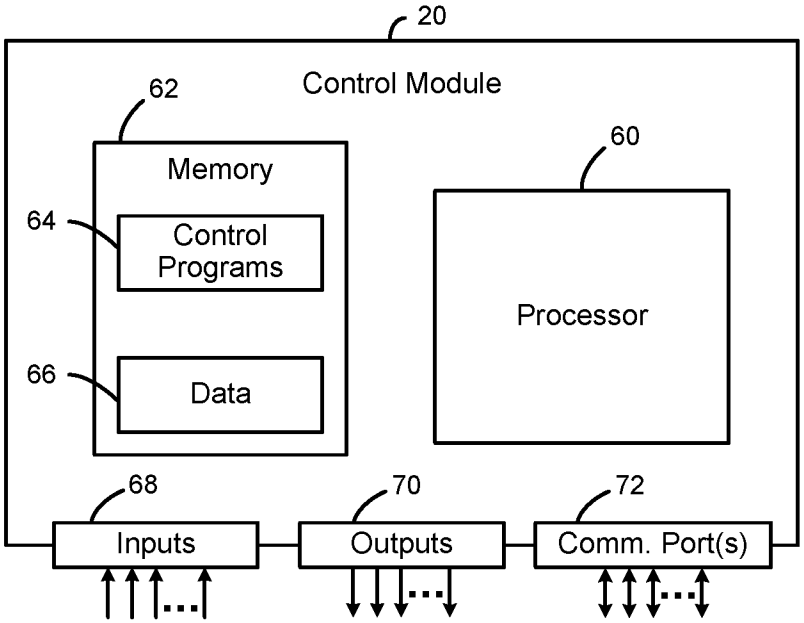
FIG. 5 is a functional block diagram of a control module according to the present disclosure.

With reference to FIG. 5, the control module 20 is shown and includes a processor 60 and memory 62. The memory 62 may store control programs 64. For example, the control programs 64 may include programs for execution by the processor 60 to perform the control algorithms for flooded start control described herein. The memory 62 also includes data 66, which may include historical operational data of the compressor 12 and refrigeration systems 10, 30. The data 66 may also include configuration data, such as setpoints and control parameters. For example, the data 66 may include system configuration data and asset data that corresponds or identifies various system components in the refrigeration system 10, 30. For example, the asset data may indicate specific component types, capacities, model numbers, serial numbers, and the like. As described in further detail below, the control module 20 can then reference the system configuration data and asset data during operation as part of the flooded start control. The control module 20 includes inputs 68, which may, for example, be connected to the various sensors, including, for example, the IR LED array, described herein. The control module 20 may also include outputs 70 for communicating output signals, such as control signals. For example, the outputs 70 may communicate control signals from the control module 20 to the compressor 12, the crankcase heater 26, and the IR LED array of the duct assembly 90, as described herein. The control module 20 may also include communication ports 72. The communication ports 72 may allow the control module 20 to communicate with other devices, such as a refrigeration system controller, a thermostat, and/or a remote monitoring device. The control module 20 may use the communication ports 72 to communicate through an internet router, Wi-Fi, or a cellular network device to a remote server for sending or receiving data.

Figure 6A:
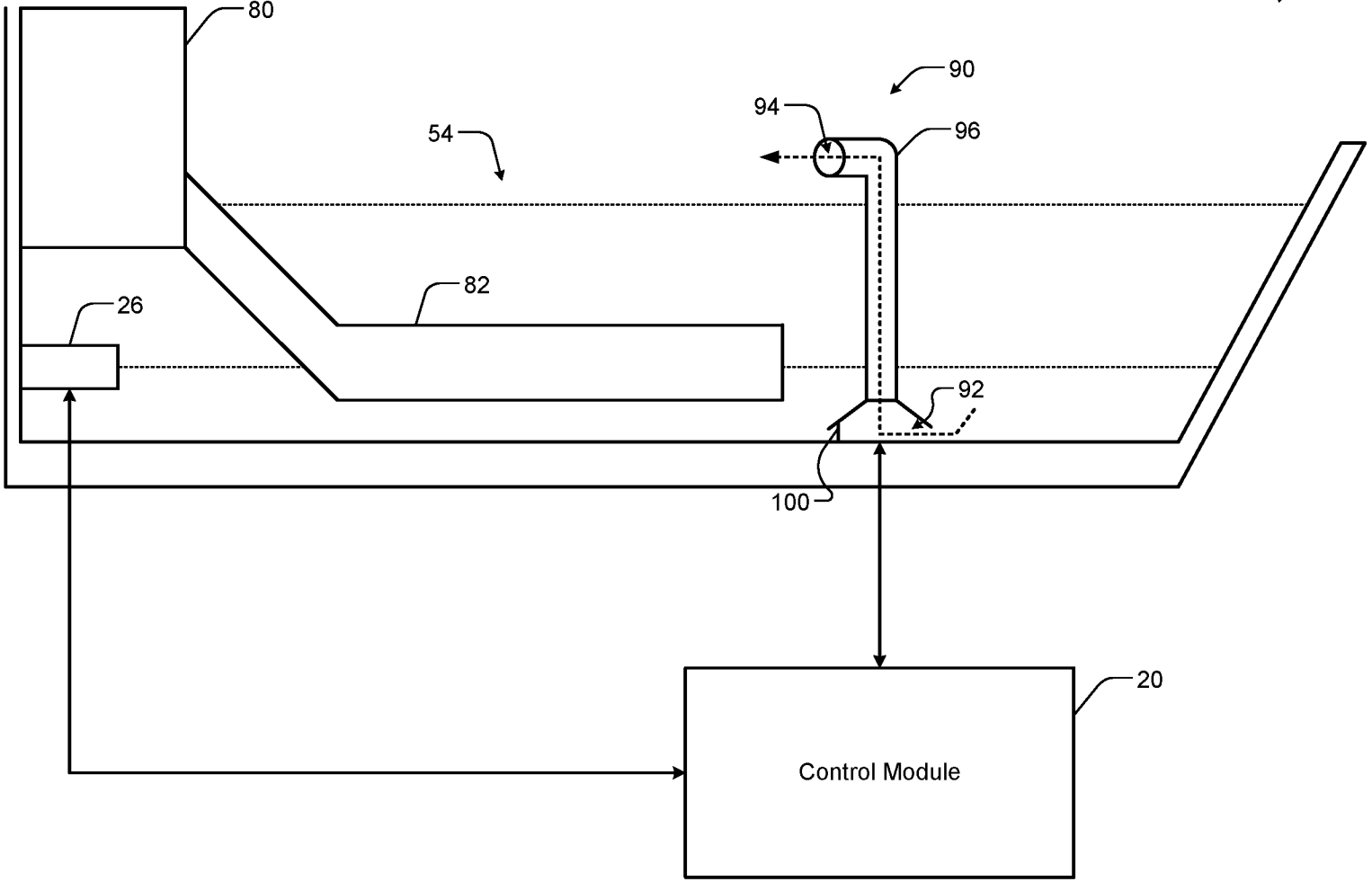
FIGS. 6A and 6B are illustrations of a duct assembly within a compressor of a refrigeration system according to the present disclosure.
Figure 6B:
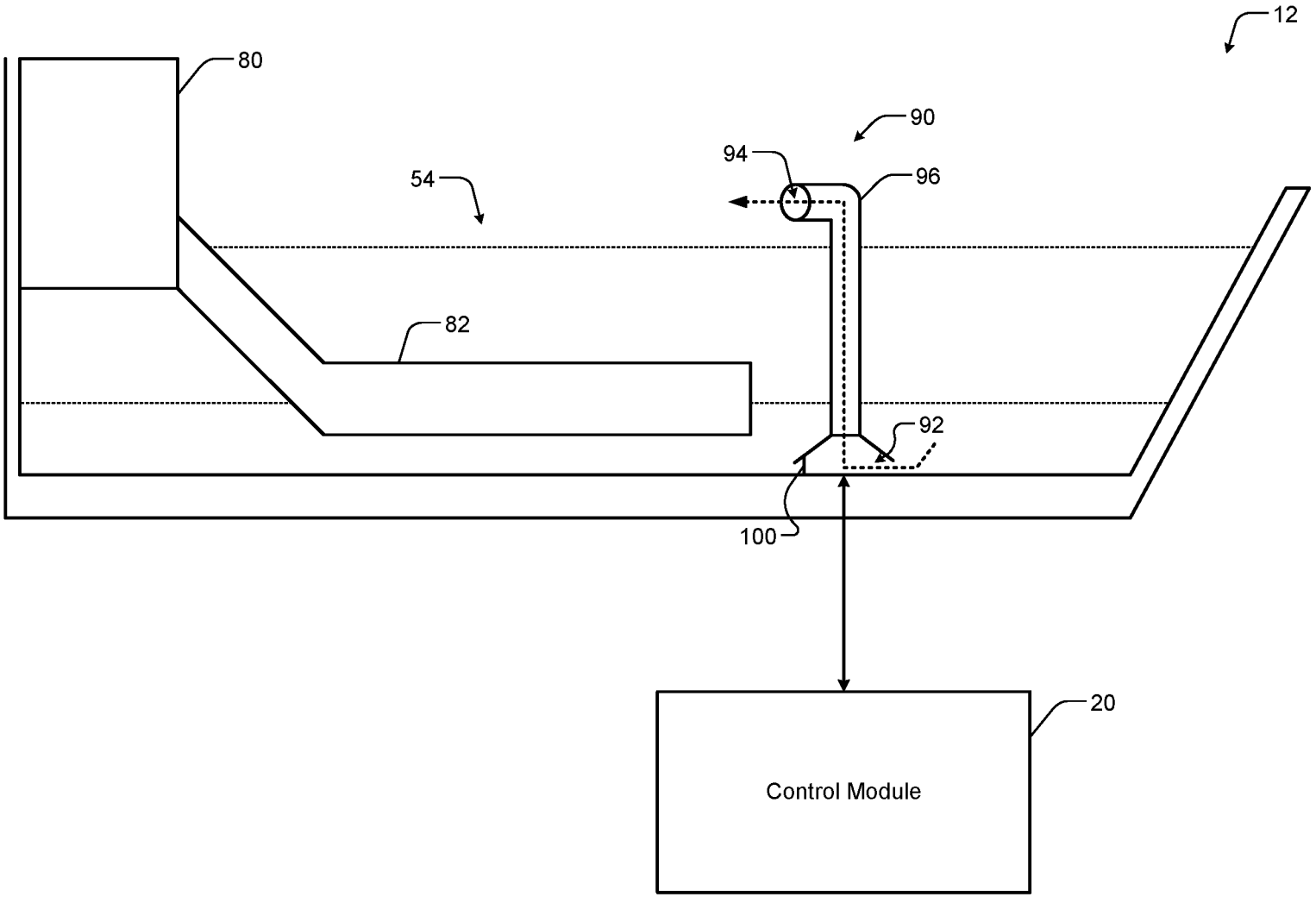

With reference to FIG. 6A, the duct assembly 90 within a lubricant sump 54 of a compressor 12 of a refrigeration system 10 is shown. The compressor 12 includes the crankcase heater 26, a lubricant pump assembly 80, a lubricant pump strainer 82, and the duct assembly 90. The control module 20 is in communication with the crankcase heater 26 and the IR LED array of the duct assembly 90, as discussed in further detail below. While this embodiment includes the crankcase heater 26, in alternative embodiments, the crankcase heater 26 may be removed from the refrigeration system 10, as shown in FIG. 6B. For example, the embodiment shown in FIG. 6B is similar to that of FIG. 6A except the embodiment shown in FIG. 6B does not include the crankcase heater 26. Additionally, while FIG. 6A shows the crankcase heater 26 that is internal to the compressor 12, crankcase heaters 26 that are external to the compressor 12 may also be used, as shown, for example, in FIG. 4. Furthermore, while FIG. 6A shows the crankcase heater 26 that is not coupled to the duct assembly 90, in alternate embodiments, a portion of the crankcase heater 26 may be coupled to the duct assembly 90.

With reference to FIGS. 6A and 6B, the lubricant pump assembly 80 is configured to, using a lubricant pump of the lubricant pump assembly 80, pump a fluid (e.g., a lubricant, such as oil) to various parts and components of the compressor 12. Generally, as the compressor 12 operates, a motor typically rotates a driveshaft, which in turn drives a compression mechanism (e.g., scrolls, pistons, screw, etc.) to compress a volume of fluid (e.g., refrigerant, etc.). Often, the driveshaft is supported by a bearing structure or assembly that is fixed to, or otherwise supported by, a shell or housing of the compressor 12. For example, the bearing assembly may be coupled to, or otherwise rotatably support, an end of the driveshaft.

As the driveshaft rotates within the bearing assembly, it can drive the lubricant pump of the lubricant pump assembly 80, which can in turn supply lubricant to the moving parts of the compressor 12. The lubricant pump strainer 82 may filter the lubricant as it is enters the lubricant pump from the lubricant sump 54. The lubricant pump can be attached to, or integrally part of, the bearing assembly. In this regard, the lubricant pump often includes a stationary member or pump housing and a moving member or pumping mechanism. The stationary member can be coupled to the bearing assembly and/or the shell of the compressor 12, and the moving member can move (e.g., rotate) within or otherwise relative to the stationary member to effectively generate a pumping action.

As discussed above, in a flooded condition the compressor 12, lubricant sump 54 may fill with a mixture of liquid refrigerant and compressor lubricant. The duct assembly 90 is configured to heat the mixture and remove the liquid refrigerant from the mixture in the lubricant sump 54 through evaporation and to provide a path for the refrigerant to flow from the lubricant sump 54 into a suction chamber of the compressor 12 as it is heated and converted from liquid to vapor by the heating action of the sensor unit of the duct assembly 90, as discussed in detail below. As further discussed in detail below, the IR LED array of the duct assembly 90 can be used to sense a temperature of the liquid mixture in the lubricant sump 54. The duct assembly 90 may be in communication with the control module 20, which is configured to, based on instructions that are executable by the processor 60 and are stored on the memory 62 (e.g., a random access memory (RAM) or read-only memory (ROM)), provide signals to the duct assembly 90 that are operable to measure a temperature of the refrigerant and lubricant mixture and/or to heat the refrigerant and lubricant mixture to evaporate the refrigerant from the mixture in the lubricant sump 54. The duct assembly 90 is described below in further detail with reference to FIGS. 7-8.

Figure 7:
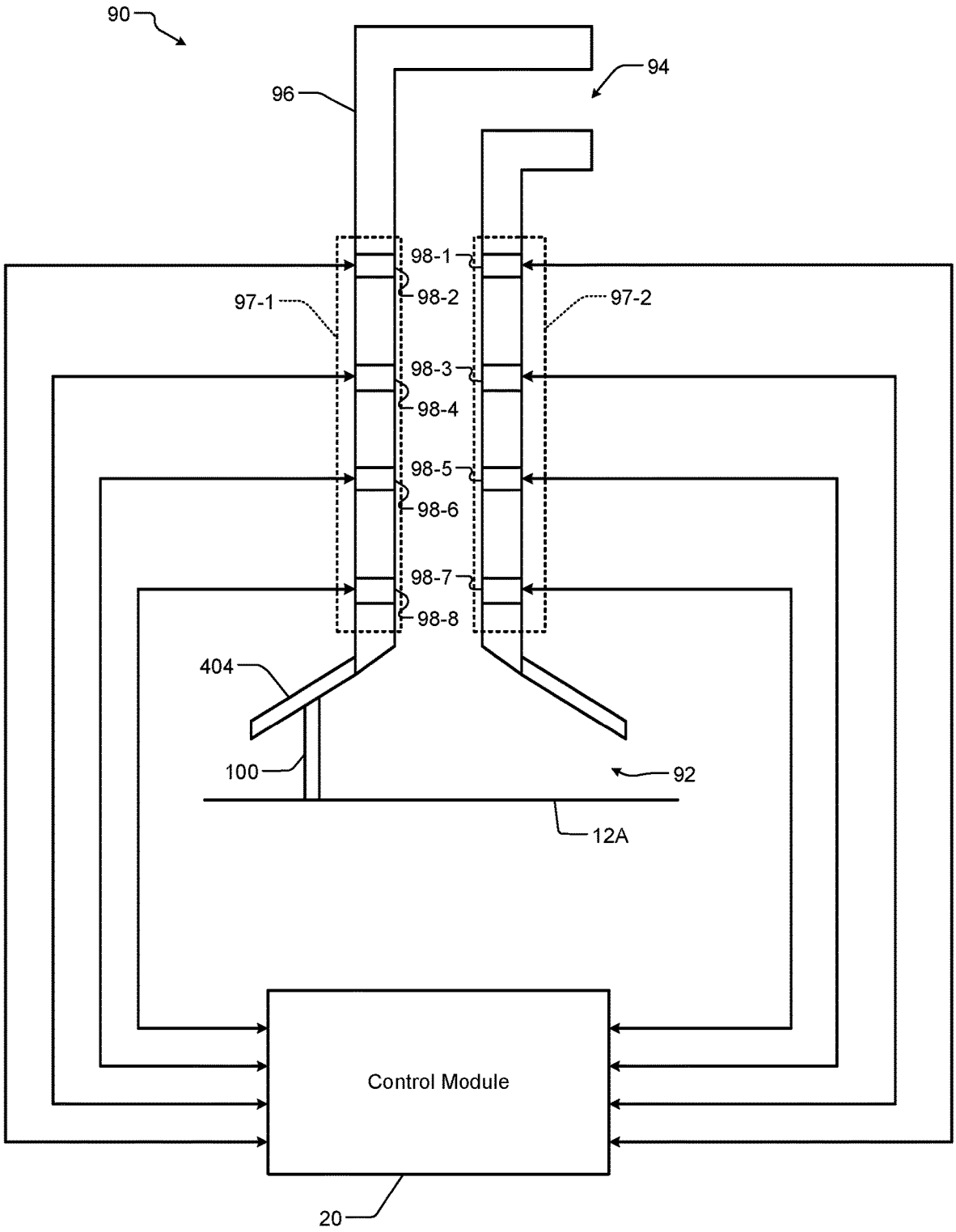
FIGS. 7-8 are example embodiments of the duct assembly according to the present disclosure.

With reference to FIG. 7, an example embodiment of the duct assembly 90 is shown. The duct assembly 90 may include an inlet port 92, an exhaust port 94, a duct frame 96, and sensor units 97-1, 97-2 (collectively referred to as sensor unit 97). The refrigerant enters the duct assembly 90 through the inlet port 92, is heated by the sensor unit 97, and exits the duct assembly 90 into a suction chamber of the compressor 12 through the exhaust port 94. In this way, liquid refrigerant in the refrigerant and lubricant mixture is heated, evaporated, and ejected from the lubricant sump 54 into the suction chamber of the compressor 12 while the lubricant remains in the lubricant sump 54. Further, the duct assembly 90 and exhaust port 94 are configured such that the heated vapor refrigerant is exhausted into the suction chamber of the compressor 12 and not recondensed by the cooler lubricant in the lubricant sump 54. An orientation of the inlet port 92 and exhaust port 94 may be implemented such that the orientation induces flow in a bulk fluid and transports the evaporated refrigerant away from a lubricant pump inlet of the lubricant pump assembly 80. Furthermore, a diameter and an angle of the exhaust port 94 and inlet port 92 may be determined based on a variety of factors including, but not limited to, internal clearances, a design of the duct frame, and a manufacturability of the system.

The duct frame 96 is a structure that defines a path in which the evaporated refrigerant is transported from the lubricant sump 54 to a suction chamber of the compressor 12. The duct frame 96 may be made of any durable material, such as injection-molded plastic, that enables the duct frame 96 to define the path in which the evaporated refrigerant is transported from the lubricant sump 54 to a suction chamber of the compressor 12. Furthermore, the duct frame 96 may be made of a material that is configured to absorb infrared (IR) radiation from the sensor unit 97 and thereby improve a vaporization capability of the duct assembly 90. Additionally, as discussed below with reference to FIGS. 12A, 12B, 13A, and 13B, a nozzle assembly with apertures may be attached to the exhaust port 94 of the duct assembly 90 to improve the vaporization capability of the duct assembly 90.

The duct frame 96 may be coupled to a bottom edge of the compressor housing 12A at an opposite end of the inlet port 92 using a mount 100. Alternatively, if the compressor 12 includes the crankcase heater 26, the mount may couple the duct frame 96 to a bottom edge of the crankcase heater 26 (not shown). The duct assembly 90 can be attached to the bottom of the compressor housing 12A using any suitable mounting and attachment mechanism. For example, a magnetic mount may be used to magnetically attach the duct assembly 90 to the compressor housing 12A. Additionally or alternatively, a bayonet and notch mechanism may be used to attach the duct assembly 90 to the compressor housing 12A. Other suitable attachment mechanisms may additionally or alternatively be used, such as, by way of non-limiting examples, clips, bolt/nut assemblies, etc.

The sensor unit 97 is configured to, in response to receiving a signal from the control module 20, measure the temperature of and/or heat the mixture of refrigerant and lubricant in the lubricant sump 54 to evaporate the refrigerant in the lubricant sump 54 of the compressor 12 into vapor refrigerant. The sensor unit 97 may include an array of IR LEDs 98-1, 98-2, . . . , 98-8, (collectively referred to as IR LEDs 98) arranged in parallel so that when one or more of the IR LEDs 98 are configured to evaporate the refrigerant, the remaining IR LEDs 98 are configured to measure the temperature of the refrigerant and/or lubricant within the duct assembly 90. As an example, IR LEDs 98-1, 98-2, 98-3, 98-4 may be configured to receive the heat signal from the control module 20 and thereby heat the refrigerant and lubricant mixture within the duct assembly 90. In such case, IR LEDs 98-5, 98-6, 98-7, 98-8 may be configured to receive a measurement signal from the control module 20 and thereby measure the temperature of the mixture of refrigerant and lubricant within the duct assembly 90, as discussed in further detail below.

Alternatively, the sensor unit 97 may include a plurality of IR LEDs 98 arranged in series so that all of the IR LEDs 98 are either evaporating or measuring the temperature of the mixture of refrigerant and lubricant within the duct assembly 90. As an example, IR LEDs 98 may be configured to receive the heat signal from the control module 20 and thereby heat the mixture of refrigerant and lubricant within the duct assembly 90 for a first period of time. Once the first period of time elapses, IR LEDs 98 may then be configured to receive the measurement signal and thereby measure the temperature of the mixture of refrigerant and lubricant within the duct assembly 90 for a second period of time. Once the second period of time elapses, the control module 20 may repeat the steps of providing the heat signal and the measurement signal until the control module 20 determines that the amount of liquid refrigerant remaining in the mixture within the lubricant sump 54 is below a predetermined level.

As another example, the sensor unit 97 may include a plurality of thermistors and/or diodes arranged in series or in parallel in addition to or instead of using the IR LEDs 98 in order to measure the temperature of the mixture of refrigerant and lubricant in the lubricant sump 54 and to evaporate the liquid refrigerant from the mixture in the lubricant sump 54 into a suction chamber of the compressor 12. Furthermore, a copper wire wrapped around the duct frame 96 may be used in addition to or instead of the IR LEDs 98 in order to measure the temperature of the mixture of refrigerant and lubricant in the lubricant sump 54 and to evaporate the liquid refrigerant from the mixture in the lubricant sump 54 into a suction chamber of the compressor 12.

In order to heat the refrigerant within the duct assembly 90, the control module 20 is configured to provide a heat signal to the IR LEDs 98 of the sensor unit 97. As an example, the control module 20 may be configured to provide a pulse-width modulated (PWM) signal to the sensor unit 97 in order to provide the heat signal to the IR LEDs 98 of the sensor unit 97. In response to receiving the PWM signal from the control module 20, the IR LEDs 98 are configured to emit infrared radiation and thereby evaporate the liquid refrigerant from the mixture within the duct assembly 90.

In order to measure the temperature of the mixture of refrigerant and lubricant within the duct assembly 90, the control module 20 is configured to provide a measurement signal to the plurality of IR LEDs 98 of the sensor unit 97. As an example, the control module 20 may be configured to provide a PWM signal to the sensor unit 97 in order to measure the temperature of the refrigerant and lubricant mixture within the duct assembly 90. Furthermore, as a result of a diode's proportional change in forward voltage in response to a change in temperature, the control module 20 can accurately determine the temperature of the refrigerant and lubricant mixture within the duct assembly 90 based on a measured forward voltage of the IR LEDs 98. In order to detect a change in forward voltage, the control module 20 may be in communication with a current source module (not shown) that is configured to provide a constant current to the IR LEDs 98 in response to receiving the PWM signal from the control module 20. The control module 20 may then be configured to obtain the forward voltages of the IR LEDs 98 and convert each of the forward voltages, using an analog-to-digital converter (ADC), to a digital value. The control module 20 may then identify, using the processor 60, a plurality of predetermined temperature values stored in the memory 62 that correspond to the digital values. Based on the identified predetermined temperature values, the control module 20 may populate a table stored in the memory 62 with data that indicates the temperature of the mixture of refrigerant and lubricant. Other factors, such as an ideality factor, a Boltzmann's constant, a forward current, and a reverse bias saturation current of the IR LEDs 98 may also affect the accuracy of the temperature calculation.

The control module 20 may be configured to provide the heat and measurement signals repeatedly until the control module 20 determines that the liquid refrigerant has evaporated from the lubricant sump 54 of the compressor 12. In order to determine whether the refrigerant has evaporated from the lubricant sump 54 of the compressor 12, the control module 20 may be configured to populate a table stored in the memory 62 with data corresponding to temperature values obtained from the measurement signals. Using the data stored in the table of the memory 62, the control module 20 may be configured to construct a heating curve for the mixture of refrigerant and lubricant within the duct assembly 90 in order to determine whether the refrigerant has evaporated from the lubricant sump 54 of the compressor 12. The control module 20 may then compare the constructed heating curve to an expected heating curve for the lubricant used in the system, which is also stored in the memory 62. If the control module 20 determines that the constructed heating curve does not correspond to the expected heating curve, then the control module 20 may be configured to determine that the liquid refrigerant is present within lubricant sump 54 of the compressor 12. Additionally or alternatively, if the control module 20 determines that the constructed heating curve does not correspond to the expected heating curve, then the control module 20 may be configured to determine that the wrong type of lubricant and/or refrigerant is present within the lubricant sump 54 of the compressor 12. Otherwise, if the control module 20 determines that the constructed heating curve corresponds to the expected heating curve, the compressor 12 is then configured to perform normal operation.

The heating curves for various fluids are distinct given the same input heat. More specifically, the heating curve as a function of time and temperature for each fluid is distinct, and therefore, a type of fluid of that is present within a system can be readily determined provided that the heating curve for the type of fluid is known. Moreover, a phase of the type of fluid (e.g., solid phase, melting, liquid phase, boiling, gas phase, etc.) can be determined based on the heating curve for that type of fluid.

As an example, assuming that the heating curve for the lubricant is already known for a certain constant input of heat and atmospheric pressure, the phase of the lubricant (e.g., liquid phase) may be determined based on the measured time and temperature. Additionally, assuming that the heating curve for the refrigerant is already known for a certain constant input of heat and atmospheric pressure, the phase of the refrigerant (e.g., gas phase) may be determined based on the measured time and temperature.

Accordingly, if the sensor unit 97 is configured such that the IR LEDs 98 of the sensor unit 97 are electrically coupled in parallel, some of the IR LEDs 98 can emit heat in response to receiving the heat signal, while the remaining IR LEDs 98 can measure the temperature of the lubricant and/or refrigerant within the duct assembly 90, as described above. Based on the amount of heat supplied to the mixture of lubricant and/or refrigerant located within the lubricant sump 54 of the compressor 12; the measured temperature of the lubricant and/or refrigerant located within the lubricant sump 54 of the compressor 12; and the amount of time that has elapsed, the control module 20 may be configured to construct a heating curve of the mixture of lubricant and/or refrigerant located within the lubricant sump 54 of the compressor 12. If the heating curve of the mixture of lubricant and/or refrigerant located within the compressor 12 does not correspond with the expected heating curve of the lubricant of the compressor 12, then the control module 20 may determine that refrigerant is present within the lubricant sump 54 of the compressor 12.

As an example, in a mixture of lubricant and refrigerant, there will be minimal temperature change during evaporation. Therefore, in response to a minimal temperature change, the control module 20 may be configured to determine that refrigerant is present within the lubricant sump 54 of the compressor 12. However, after the refrigerant is completely evaporated, then the heating curve will begin to fit the characteristic of the lubricant. Therefore, in response to determining that the heating curve of the original mixture corresponds to the heating curve of the lubricant, the control module 20 may be configured to determine that the refrigerant has been completely evaporated from the lubricant sump 54 of the compressor 12 and thus can perform normal operation.

Figure 11:
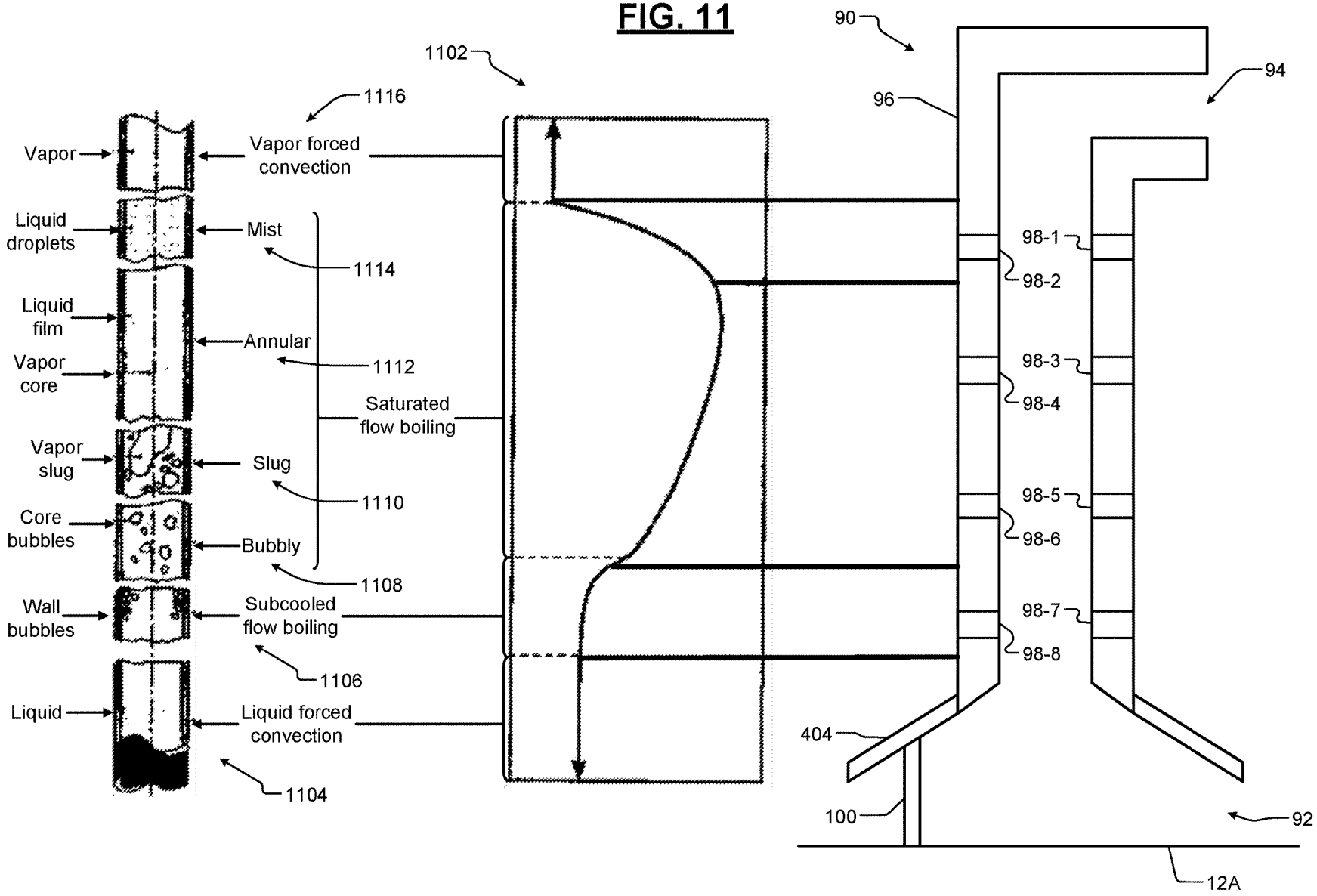
FIG. 11 is an illustration of an evaporation profile for refrigerant in a duct assembly according to the present disclosure.

Furthermore, if the sensor unit 97 is configured such that the IR LEDs 98 of the sensor unit 97 are electrically coupled in parallel, the sensor unit 97 may be configured to determine an evaporation profile of the refrigerant in the duct assembly 90. For example, an example evaporation profile 1102 of the refrigerant in the duct assembly 90 is shown in FIG. 11. In the duct assembly 90, the refrigerant enters through the inlet port 92 subcooled (i.e., at a lower temperature than the saturation temperature). The refrigerant may be a single-phase liquid when it enters through the inlet port 92, as shown at 1104. As the duct assembly 90 temperature rises in response to the heat signals, the refrigerant temperature correspondingly rises. As the refrigerant temperature approaches a saturation temperature, subcooled boiling begins, as shown at 1106, and bubbles containing the refrigerant begin to form within and along the duct frame 96 (i.e., bubbly flow, as shown at 1108). As the refrigerant temperature exceeds the saturation temperature, the refrigerant bubbles begin to rise and convert into refrigerant slugs of vapor (i.e., slug flow, as shown at 1110).

Further increases in temperature of the duct assembly 90 cause the refrigerant slugs of vapor to rise and form a refrigerant vapor core that is surrounded by a refrigerant liquid film that contacts the duct frame 96 (i.e., annular flow, as shown at 1112). As the refrigerant vapor core that is surrounded by the refrigerant liquid film increases in temperature, the refrigerant liquid film begins to form small droplets along the duct frame 96, while the refrigerant vapor core expands (i.e., mist flow, as shown at 1114). Further increases in the refrigerant causes vapor forced convection, as shown at 1116, wherein the refrigerant vapor core is expelled from the duct assembly 90.

Moreover, during each state of convection boiling, a coefficient of heat transfer of the refrigerant is different. As an example, the heat transfer coefficient of the refrigerant may peak during the mist flow state of convection boiling, while during vapor forced convection, the heat transfer coefficient of the refrigerant sharply decreases to a minimum value. Accordingly, the control module 20 may be configured to determine a plurality of heating coefficients along the duct assembly 90, thereby providing an accurate evaporation profile of the refrigerant in the duct assembly 90. As such, an additional IR LED 98 of the sensor unit 97 may be coupled to an outer surface of the duct frame 96, thereby allowing the control module 20 to calculate a difference in temperature between the duct frame 96 and the refrigerant located therein. From this temperature difference, the control module 20 may be able to determine the coefficient of heat transfer at various locations within the duct assembly 90. Based on the various coefficients of heat transfer at the various locations along the duct assembly 90, the control module 20 may be configured to determine whether liquid refrigerant is located within the lubricant sump 54 of the compressor 12.

In addition to the control module 20 being configured to determine the heating curve and/or the presence of the refrigerant and/or lubricant within the duct assembly 90, the control module 20 may be configured to determine a liquid level of the refrigerant and/or lubricant within the duct assembly 90. As an example, the control module 20 may be configured to construct a plurality of heating curves, wherein each heating curve of the plurality of heating curves is associated with a respective location of the duct assembly 90. As a more specific example, each heating curve of the plurality of heating curves may be associated with at least one of the IR LEDs 98 (e.g., a first heating curve is associated with IR LEDs 98-7, 98-8; a second heating curve is associated with IR LEDs 98-5, 98-6, etc.) Based on the plurality of heating curves, the control module 20 may determine the liquid level of the refrigerant and/or lubricant. As an example, if the first heating curve indicates that the lubricant and/or refrigerant is in a liquid phase, and the second heating curve indicates that the lubricant and/or refrigerant is a gas phase, the control module 20 may determine that the liquid level of the lubricant and/or refrigerant is at or near a location associated with IR LEDs 98-7, 98-8.

Furthermore, the control module 20 may be configured to determine a volume of the lubricant within the duct assembly 90. As an example, while the sensor unit 97 heats the mixture of lubricant and refrigerant within the duct assembly 90, a heated portion of the mixture is ejected through the exhaust port 94 and spreads throughout the sump 54. Meanwhile, the inlet port 92 continues to receive a cooler portion of the mixture. Once the entire volume of the mixture in the sump has entered, been heated by, and exited the duct assembly 90, a first cycle time ($T_1$) of the duct assembly 90 has elapsed. The first cycle time may be based on, for example, an amount of heat generated by the sensor unit 97, the composition of the mixture, and the geometry of the duct assembly 90, and/or the temperature of the mixture. Moreover, the temperature of the mixture may be obtained by the control module 20 at, for example, a Nyquist sampling frequency.

In some embodiments, the refrigerant in the mixture may not be completely evaporated after the completion of the first cycle time. As such, the mixture may (i) reenter the inlet port 92 of the duct assembly 90, (ii) be heated by the sensor unit 97 of the duct assembly 90, and (iii) be ejected from the duct assembly 90 via the exhaust port 94. This process may be repeated until the refrigerant of the mixture is completely evaporated and removed from the sump 54. Each iteration of the process may be associated with a corresponding cycle time ($T_n$). As such, the control module 20 may be configured to, based on at least one of the cycle times, determine the volume of the lubricant within the sump 54.

Additionally or alternatively, the control module 20 may be configured to determine the volume of the lubricant in the sump 54 based on a temperature-time curve of the mixture. As an example, after a predefined period of time elapses, the temperature of the mixture may conform with the Arrhenius equation. As an example, the temperature may be determined by a setpoint temperature associated with the lubricant, the Boltzmann constant, a pre-exponential/frequency factor, and a time that the sensor unit 97 of the duct assembly 90 is activated. Based on the temperature and the elapsed time, the control module 20 may subsequently determine the volume of the lubricant in the sump 54.

Figure 8:
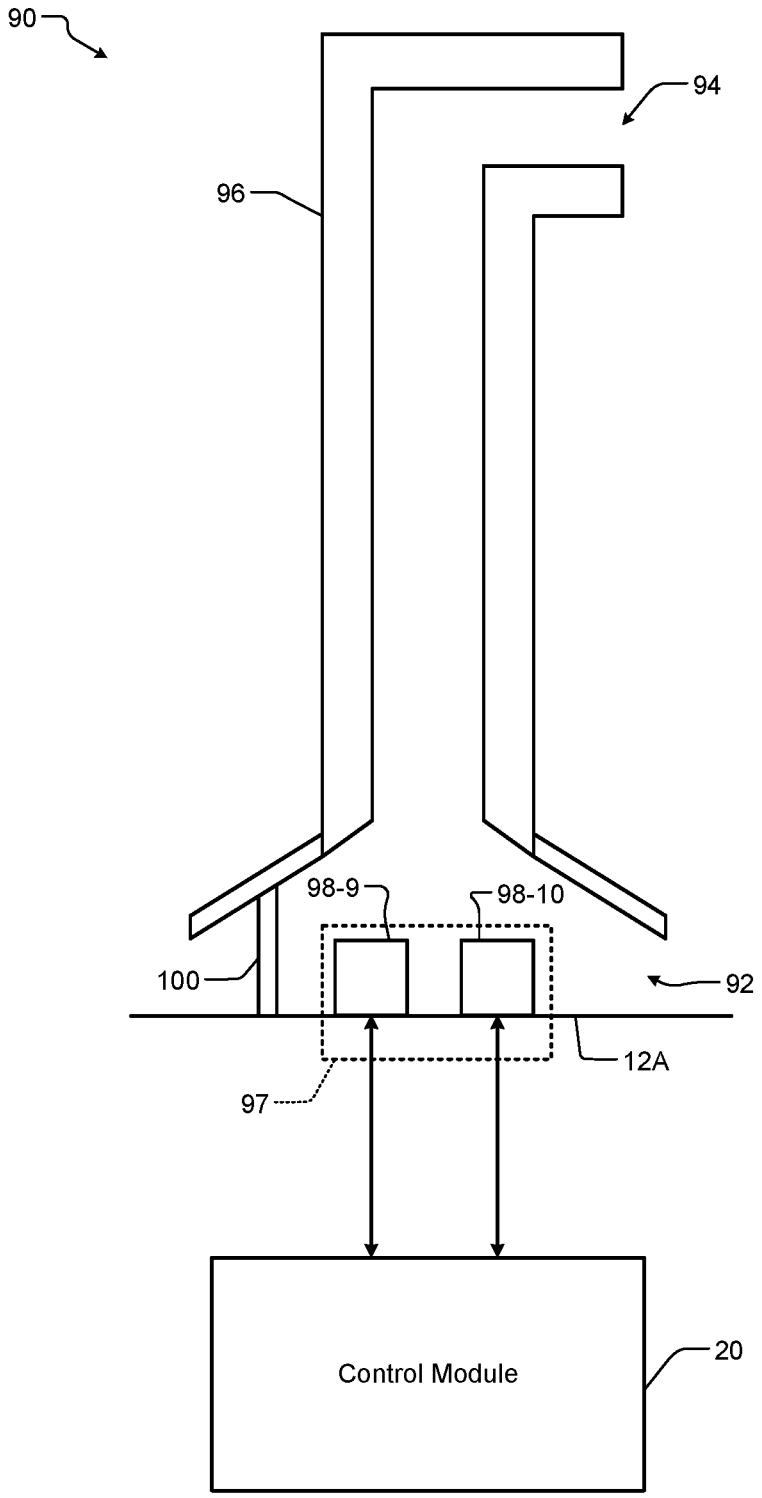

With reference to FIG. 8, another example embodiment of the duct assembly 90 is shown. The duct assembly 90 of FIG. 8 is similar to the duct assembly 90 of FIG. 7, except that the duct frame 96 does not include the sensor unit 97. Rather, the sensor unit 97 and IR LEDs 98-9, 98-10 are independent of the duct frame 96 and are attached to the bottom edge of the compressor housing 12A. Alternatively, if the compressor 12 includes the crankcase heater 26, the sensor unit 97 may be coupled to the bottom edge of the crankcase heater housing (not shown).

Figure 9:
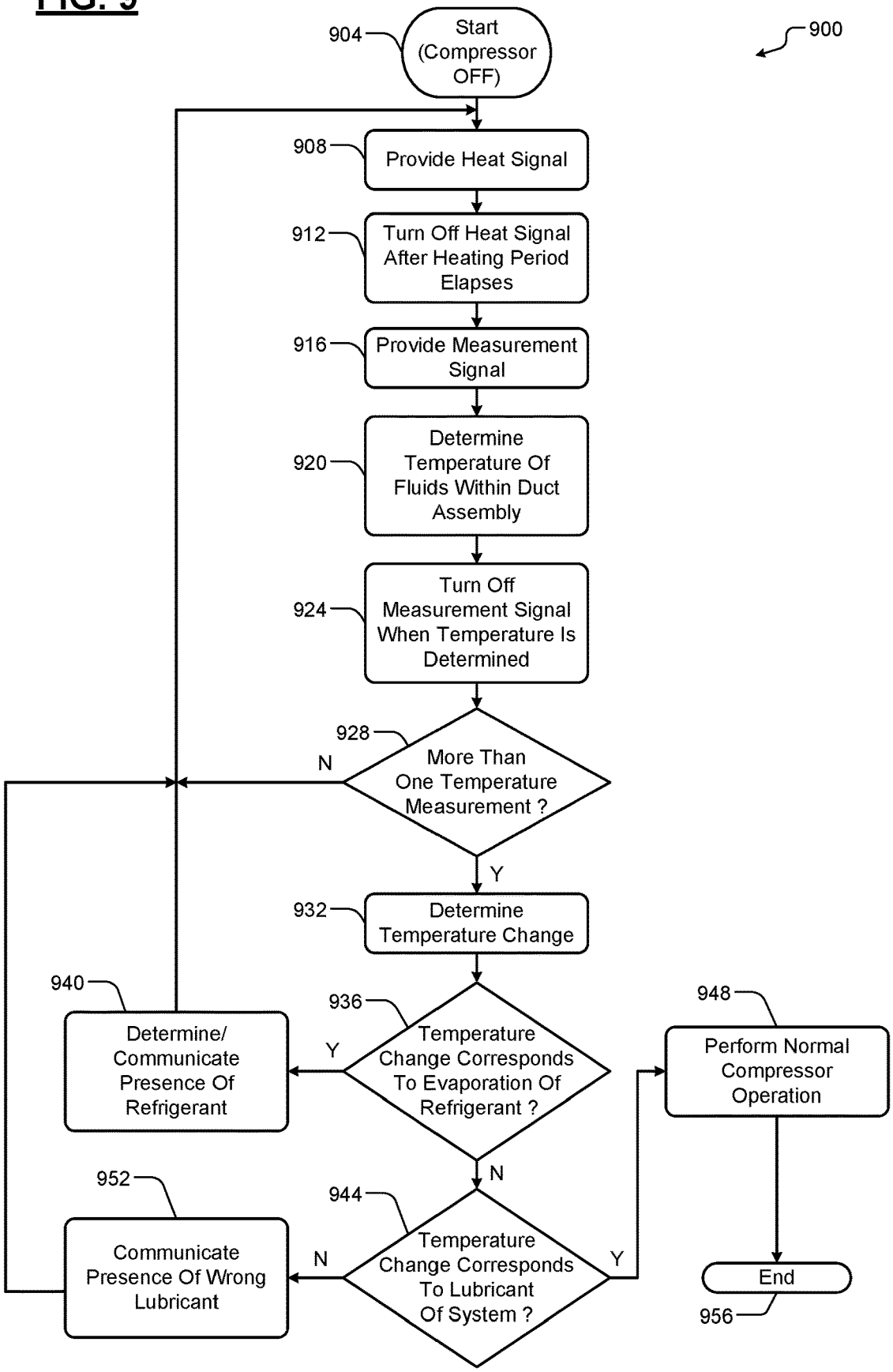
FIG. 9 is a flowchart for a control algorithm according to the present disclosure.

With reference to FIG. 9, a control algorithm 900 for performing flooded start control is shown using the sensor unit 97 with IR LEDs 98 configured in series. The control algorithm 900 may be performed, for example, by the control module 20. Further, the control algorithm 900 may be performed when the compressor 12 is currently off and there has been a request, control command, or demand for the compressor 12 to turn on. Additionally, or alternatively, flooded start control may be performed when the compressor 12 is off, but there is not a request or control command or demand for the compressor 12 to turn on.

The control algorithm 900 starts at 904. At 908, the control algorithm 900, using the control module 20, provides the heat signal for the first period of time to the sensor unit 97 of the duct assembly 90. At 912, the control algorithm 900, using the control module 20, stops providing the heat signal to the sensor unit 97 after the first period of time elapses and then provides the measurement signal to the sensor unit 97 for the second period of time at 916. At 920, once the second period of time has elapsed, using the control module 20, the control algorithm 900 determines the temperature of the fluids within the duct assembly 90 based on, for example, the change in forward voltages of the IR LEDs 98. Once the control module 20 has determined the temperature of the fluids within the duct assembly 90, the control module 20 turns off the measurement signal at 924. At 928, the control algorithm determines whether more than one temperature measurement has been recorded. If so, the control algorithm proceeds to 932; otherwise, the control algorithm returns to 908. At 932, the control algorithm 900, using the control module 20, determines the temperature change between, for example, two consecutive temperature measurements.

At 936, the control algorithm determines whether the temperature change corresponds to the refrigerant being completely evaporated from the compressor 12. To determine whether the temperature change is indicative of the refrigerant being completely evaporated from the compressor 12, the control module 20 may construct the heating curve using the multiple temperature measurements. The control module 20 may then compare the constructed heating curve to the expected heating curve of the lubricant and/or the refrigerant used in the system to determine whether the temperature change corresponds to the evaporation of the refrigerant. If the control algorithm 900 determines that the temperature change corresponds to the presence of the liquid refrigerant in the lubricant sump 54, the control algorithm 900 proceeds to 940; otherwise, the control algorithm 900 proceeds to 944. Additionally, the control algorithm 900 may be configured to determine that the temperature change corresponds to the presence of the wrong type of liquid refrigerant in the lubricant sump 54.

At 940, the control algorithm determines and communicates a notification or alert, using the control module 20, indicating the presence of the refrigerant and/or wrong type of refrigerant and returns to 908. As an example, the control module 20 may communicate the presence of a refrigerant to an operator using a visual alert (i.e., a flashing LED located on the compressor housing) or an auditory alert (i.e., a beep or loud audio tone) or may output a notification to, for example, a system controller, a thermostat, a remote server, a user device, such as a smartphone, or other connected computing device capable of receiving such a notification.

At 944, the control algorithm 900, using the control module 20, determines whether the temperature change corresponds to the lubricant of the system. As an example, the control algorithm 900 may be able to determine that an improper lubricant or liquid is located within the compressor 12 if the temperature change of the constructed heating curve does not correspond with the temperature change of the specific lubricant used for the compressor 12. If the control algorithm 900 determines that the temperature change corresponds to the temperature change of the specific lubricant used for the compressor 12, the control algorithm 900 proceeds to 948; otherwise, the control algorithm proceeds to 952 and communicates a notification or alert indicating the presence of the wrong type of lubricant. For example, the control module 20 may communicate the presence of the wrong type of lubricant to an operator using a visual alert (i.e., a flashing LED located on the compressor housing) or an auditory alert (i.e., a beep or loud audio tone) or may output a notification to, for example, a system controller, a thermostat, a remote server, a user device, such as a smartphone, or other connected computing device capable of receiving such a notification. At 948, the compressor 12 initiates and performs normal compressor operation and then ends at 956.

Figure 10:
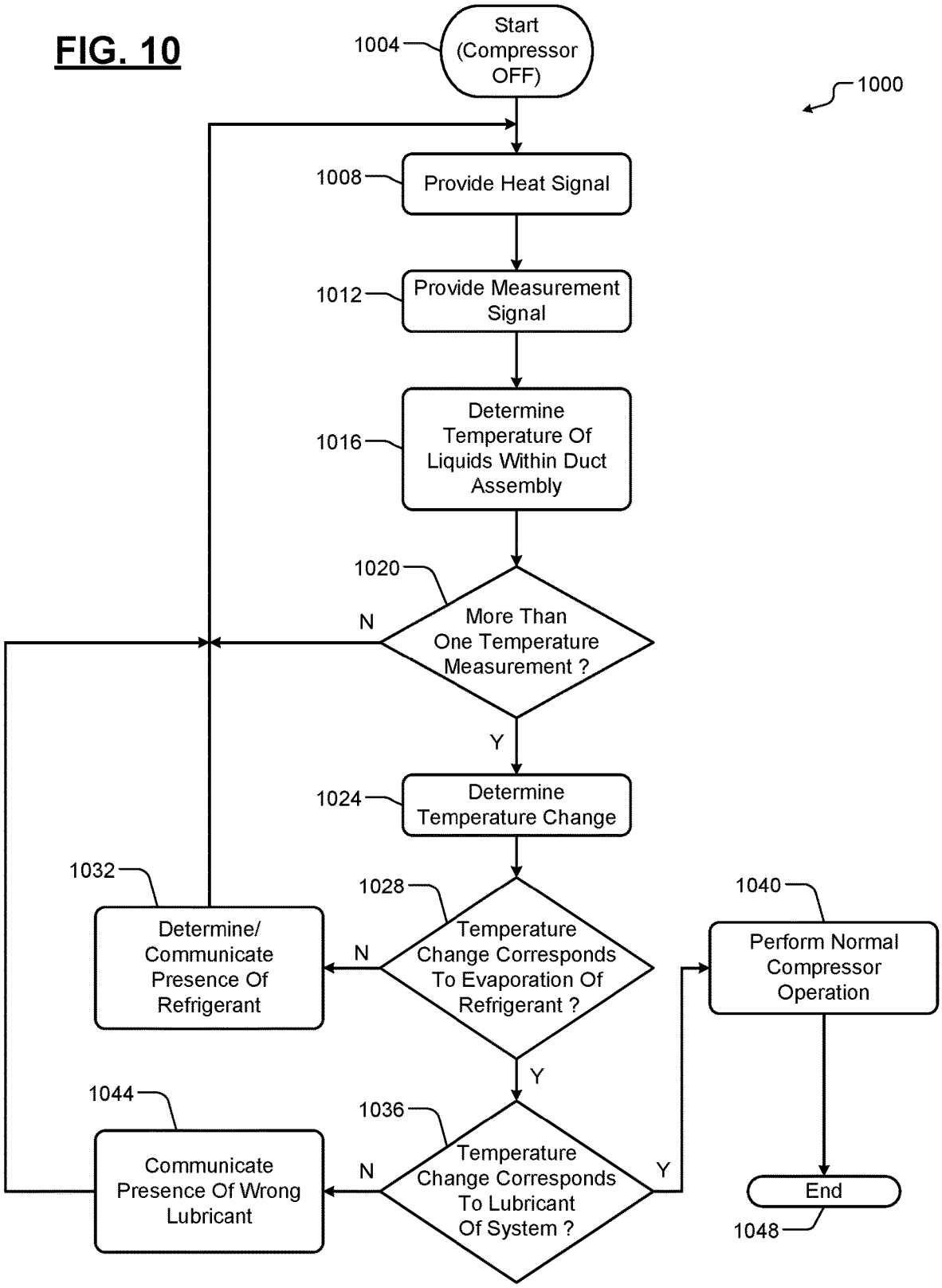
FIG. 10 is another flowchart for a control algorithm according to the present disclosure.

With reference to FIG. 10, a control algorithm 1000 for performing flooded start control is shown using the sensor unit 97 with IR LEDs 98 configured in parallel. The control algorithm 1000 may be performed, for example, by the control module 20. Further, the control algorithm 1000 may be performed when the compressor 12 is currently off and there has been a request or control command or demand for the compressor 12 to turn on. Additionally or alternatively, flooded start control may be performed when the compressor 12 is off, but there is not a request or control command or demand for the compressor 12 to turn on. The control algorithm 1000 starts at 1004.

At 1008, the control algorithm 1000, using the control module 20, provides the heat signal to the sensor unit 97 of the duct assembly 90. At 1012, the control algorithm provides the measurement signal to the sensor unit 97 of the duct assembly 90. At 1016, the control algorithm, using the control module 20, determines the temperature of the liquid mixture within the duct assembly 90 based on, for example, the change in forward voltages of the IR LEDs 98 of the sensor unit 97.

At 1020, the control algorithm 1000 determines whether more than one temperature measurement has been recorded. If so, the control algorithm 1000 proceeds to 1024; otherwise, the control algorithm returns to 1008. At 1024, the control algorithm 1000, using the control module 20, determines the temperature change between, for example, two consecutive temperature measurements.

At 1028, the control algorithm determines whether the temperature change corresponds to refrigerant being completely evaporated from the lubricant sump 54 of the compressor 12. To determine whether the temperature change is indicative of the refrigerant being completely evaporated from the compressor 12, the control module 20 may construct the heating curve using multiple temperature measurements. The control module 20 may then compare the constructed heating curve may to the expected heating curve of the lubricant and/or the refrigerant used in the system to determine whether the temperature change corresponds to the evaporation of the refrigerant. If the control algorithm 1000 determines that the temperature change corresponds to the presence of the refrigerant, the control algorithm 1000 proceeds to 1032; otherwise, the control algorithm proceeds to 1036. Additionally, the control algorithm 1000 may be configured to determine that the temperature change corresponds to the presence of the wrong type of liquid refrigerant in the lubricant sump 54.

At 1032, the control algorithm 1000 determines and communicates a notification or alert, using the control module 20, indicating the presence of the refrigerant and/or wrong type of refrigerant and returns to 1008. As an example, the control module 20 may communicate the presence of a refrigerant to an operator using a visual alert (i.e., a flashing LED located on the compressor housing) or an auditory alert (i.e., a beep or loud audio tone) or may output a notification to, for example, a system controller, a thermostat, a remote server, a user device, such as a smartphone, or other connected computing device capable of receiving such a notification.

At 1036, the control algorithm 1000, using the control module 20, determines whether the temperature change corresponds to the lubricant of the system. As an example, control algorithm 1000 may be able to determine that an improper lubricant is located within the compressor 12 if the temperature change of the constructed heating curve does not correspond with the temperature change of the specific lubricant used for the compressor 12. If the control algorithm 1000 determines that the temperature change corresponds to the temperature change of the specific lubricant used for the compressor 12, the control algorithm proceeds to 1040; otherwise, the control algorithm proceeds to 1044 and communicates a notification or alert indicating the presence of the wrong type of lubricant. For example, the control module 20 may communicate the presence of the wrong type of lubricant to an operator using a visual alert (i.e., a flashing LED located on the compressor housing) or an auditory alert (i.e., a beep or loud audio tone) or may output a notification to, for example, a system controller, a thermostat, a remote server, a user device, such as a smartphone, or other connected computing device capable of receiving such a notification. At 1040, the compressor 12 initiates and performs normal compressor operation and then ends at 1048.

Figure 12B:
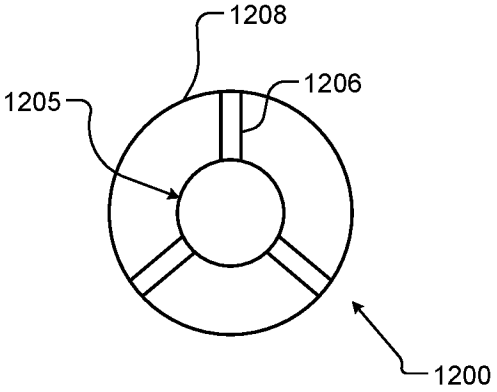
FIGS. 12A and 12B are illustrations of an outlet nozzle of the duct assembly according to the present disclosure.
Figure 12A:
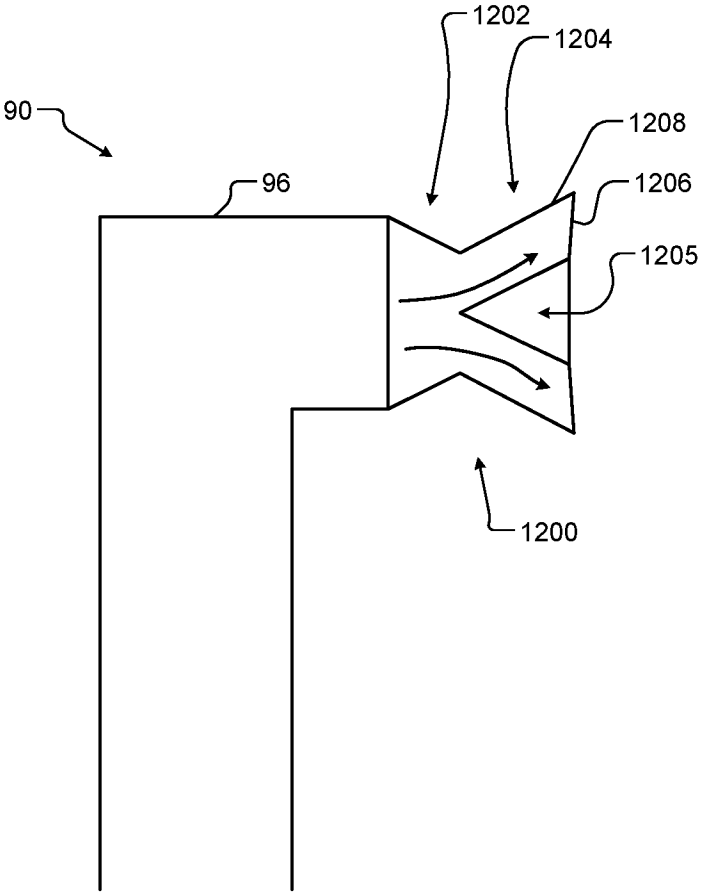

With reference to FIGS. 12A and 12B, a nozzle assembly 1200 may be attached to the exhaust port of the duct assembly 90 to improve the vaporization capability of the duct assembly 90. Specifically, FIG. 12A is a size cross-sectional view of the nozzle assembly 1200 while FIG. 12B is a front view of the nozzle assembly 1200. The nozzle assembly 1200 is located at an end of the exhaust port and is attached to or formed with the duct frame 96 of the duct assembly 90. The nozzle assembly 1200 shown in FIGS. 12A and 12B is a converging-diverging nozzle, which includes both a converging portion 1202 and a diverging portion 1204. The converging portion 1202 narrows in diameter in the direction of the flow within the nozzle assembly 1200 while the diverging portion 1204 increases in diameter in the direction of the flow within the nozzle assembly 1200. Further, the nozzle assembly 1200 includes an inner cone 1205 within the diverging portion 1204. The inner cone 1205 is attached to a sidewall 1208 of the diverging portion 1204 via supports 1206. While three supports 1206 are shown in FIG. 12B, any number of supports 1206 can be used. The converging-diverging configuration of the nozzle assembly 1200, in conjunction with the inner cone 1205, increases the vaporization capability of the duct assembly 90. For example, a velocity of the flow within the nozzle assembly 1200 may increase as the flow enters and proceeds through the converging portion 1202 of the nozzle assembly 1200. The flow then enters the diverging portion 1204 and is directed to an outer circumference of the diverging portion 1204 of the nozzle assembly 1200 by the inner cone 1205 and dispersed as the flow exits the nozzle assembly 1200.

Figure 13B:
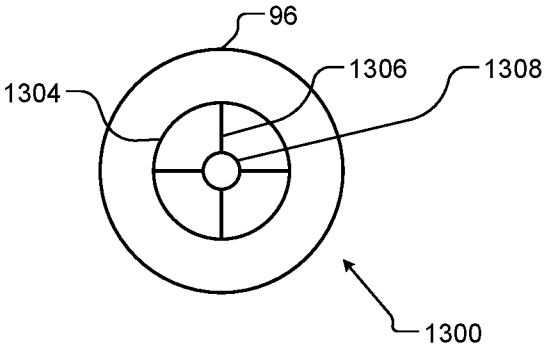
FIGS. 13A and 13B are illustrations of another outlet nozzle of the duct assembly according to the present disclosure.
Figure 13A:
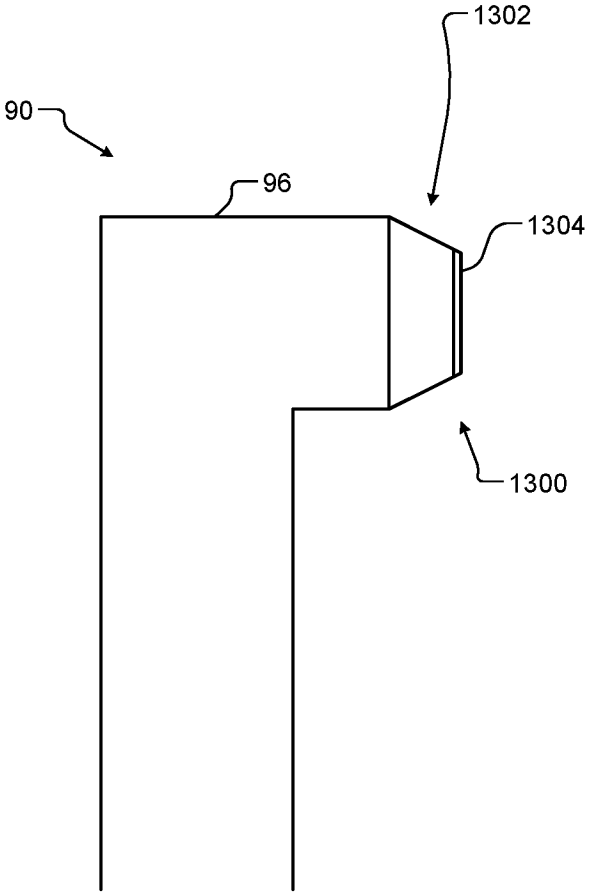

With reference to FIGS. 13A and 13B, another nozzle assembly 1300 configuration to improve the vaporization capability of the duct assembly 90 is shown. The nozzle assembly 1300 shown in FIGS. 13A and 13B includes a converging portion 1302 and a cover piece 1304 that attaches to an end of the converging portion 1302 of the nozzle assembly 1300. As shown in FIG. 13B, the cover piece 1304 includes supports 1306 that connect a center piece 1308 to a sidewall of the cover piece 1304. While four supports 1306 are shown in FIG. 13B, any number of supports may be used. The center piece 1308 may have a flat configuration, or may be configured as an inner cone, similar to the inner cone 1205 shown in FIGS. 12A and 12B. In this way, a velocity of the flow within the nozzle assembly 1300 increases as the flow enters the converging portion 1302 of the nozzle assembly 1300 and is then dispersed by the supports 1306 and center piece 1308 as the flow exits the nozzle assembly 1300.

While a converging-diverging nozzle assembly 1200 is shown in FIGS. 12A and 12B and a converging nozzle assembly 1300 is shown in FIGS. 13A and 13B, any suitable nozzle assembly configuration may be used. For example, a diverging nozzle assembly may be used. In addition, a fluted nozzle assembly may be used. In all of the nozzle assemblies, an inner surface of the nozzle assembly may be crenelated with saw tooth or squared notches to improve the vaporization capability of the duct assembly 90. Additionally or alternatively, the inner surface of the nozzle assembly may be knurled or irregularly shaped to improve the vaporization capability of the duct assembly 90. These textures and features within the inner surface of the nozzle assembly can capture any liquid remaining within the flow, impact pressure of the flow within the nozzle assembly, change the turbulence of the flow within the nozzle assembly, etc.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, Python®, LabVIEW, LLVM bytecode, Flowcode, Neural Network programming, and Fuzzy Control language.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A system comprising:

a compressor for a refrigeration system, the compressor having a suction chamber and a lubricant sump containing a mixture of liquid refrigerant and a lubricant;

a duct assembly, located in the lubricant sump, that includes a duct frame and a sensor unit, the duct frame providing an enclosed path for evaporating the liquid refrigerant from the mixture in the lubricant sump to the suction chamber of the compressor, the sensor unit having at least one diode, the sensor unit being configured to:

in response to receiving measurement signals, obtain temperature measurements of the mixture within the lubricant sump with the at least one diode; and in response to receiving a heat signal, heat and evaporate the liquid refrigerant located within the duct frame of the duct assembly with the at least one diode; and a control module that includes a processor configured to execute instructions stored in a non-transitory memory, wherein the instructions include:

supplying a first measurement signal to the sensor unit;

receiving a first temperature measurement from the sensor unit;

supplying the heat signal to the sensor unit;

supplying a second measurement signal to the sensor unit;

receiving a second temperature measurement from the sensor unit;

determining a temperature change of the mixture based on the first and second temperature measurements;

determining whether the temperature change corresponds to an expected temperature change for the lubricant;

determining whether the liquid refrigerant remains present within the lubricant sump of the compressor after supplying the heat signal to the sensor unit based on the determination of whether the temperature change corresponds to the expected temperature change for the lubricant;

in response to determining that the liquid refrigerant remains present within the lubricant sump, prohibiting operation of the compressor; and in response to determining that the liquid refrigerant does not remain present within the lubricant sump, operating the compressor.

2. The system of claim 1, wherein the duct assembly includes an inlet port, an exhaust port, and a mount.

3. The system of claim 2, wherein the duct assembly is configured to allow the liquid refrigerant to enter the duct assembly from the lubricant sump through the inlet port and to allow evaporated refrigerant to exit the duct assembly into the suction chamber through the exhaust port.

4. The system of claim 2, wherein the mount is configured to couple a first side of the duct frame to a bottom edge of the compressor.

5. The system of claim 2, wherein a nozzle assembly is attached to the exhaust port.

6. The system of claim 5, wherein the nozzle assembly has a converging portion.

7. The system of claim 6, wherein the nozzle assembly has a diverging portion.

8. The system of claim 7, wherein the nozzle assembly has an inner cone within the diverging portion.

9. The system of claim 2, wherein the duct frame is configured to absorb infrared light.

10. The system of claim 2, wherein the duct frame includes injection molded plastic.

11. The system of claim 1, wherein the at least one diode includes an infrared light emitting diode.

12. The system of claim 1, wherein the instructions further comprise supplying the heat signal to the sensor unit using a pulse-width modulation signal.

13. The system of claim 1, wherein the instructions further comprise determining an actual heat curve of the mixture based on the temperature measurements.

14. The system of claim 13, wherein the instructions further comprise comparing the actual heat curve of the mixture with an actual heat curve for the lubricant.

15. The system of claim 1, wherein the instructions further comprise:

in response to a heating period elapsing, (i) discontinue supplying the heat signal to the sensor unit, and (ii) supply a measurement signal to the sensor unit.

* * * * *